US007080460B2

(12) United States Patent
Illfelder

(10) Patent No.: US 7,080,460 B2
(45) Date of Patent: Jul. 25, 2006

(54) DETERMINING A BOREHOLE AZIMUTH FROM TOOL FACE MEASUREMENTS

(75) Inventor: Herbert M. J. Illfelder, Houston, TX (US)

(73) Assignee: PathFinder Energy Sevices, Inc., Houston, TX (US)

( * ) Notice: Subject to any disclaimer, the term of this patent is extended or adjusted under 35 U.S.C. 154(b) by 94 days.

(21) Appl. No.: 10/862,558

(22) Filed: Jun. 7, 2004

(65) Prior Publication Data

US 2005/0268476 A1 Dec. 8, 2005

(51) Int. Cl.
*E21B 47/022* (2006.01)

(52) U.S. Cl. ..... 33/313; 33/302

(58) Field of Classification Search ..... 33/302, 33/303, 304, 312, 313
See application file for complete search history.

(56) References Cited

U.S. PATENT DOCUMENTS

| | | | | |
|---|---|---|---|---|
| 3,725,777 | A | 4/1973 | Robinson et al. | |
| 5,128,867 | A * | 7/1992 | Helm | 33/313 |
| 5,512,830 | A | 4/1996 | Kuckes | |
| 5,657,826 | A | 8/1997 | Kuckes | |
| 5,675,488 | A | 10/1997 | McElhinney | |
| 5,787,997 | A * | 8/1998 | Hartmann | 175/45 |
| 6,321,456 | B1 | 11/2001 | McElhinnney | |
| 6,480,119 | B1 * | 11/2002 | McElhinney | 33/304 |
| 6,631,563 | B1 * | 10/2003 | Brosnahan et al. | 33/313 |
| 2001/0041963 | A1 * | 11/2001 | Estes et al. | 702/6 |
| 2002/0144417 | A1 | 10/2002 | Russell et al. | |
| 2003/0070844 | A1 * | 4/2003 | Radzinski et al. | 175/45 |
| 2003/0209365 | A1 * | 11/2003 | Downton | 175/50 |
| 2004/0073369 | A1 | 4/2004 | McElhinney | |
| 2004/0238222 | A1 * | 12/2004 | Harrison | 175/61 |
| 2004/0249573 | A1 * | 12/2004 | McElhinney | 702/7 |

FOREIGN PATENT DOCUMENTS

| | | |
|---|---|---|
| GB | 1585479 | 3/1981 |
| GB | 2086055 A | 5/1982 |
| GB | 2321970 A | 8/1998 |
| GB | 2331811 A | 6/1999 |
| GB | 2370645 A | 7/2002 |
| GB | 2394779 A | 5/2004 |
| GB | 2398638 A | 8/2004 |
| GB | 2398879 A | 9/2004 |
| GB | 2402746 A | 12/2004 |
| GB | 2405927 A | 3/2005 |

OTHER PUBLICATIONS

F.J. Schuh, Trajectory Equations for Constant Tool Face Angle Deflections, IADC/SPE 23853, p. 111-123, (1992).

G. McElhinney, R. Sognnes, B. Smith, Case Histories Demonstrate a New Method for Well Avoidance and Relief Well Drilling, SPE/IADC 37667 (1997).

(Continued)

*Primary Examiner*—G. Bradley Bennett

(57) ABSTRACT

A method for surveying a subterranean borehole is provided. The method includes determining tool face angles at first and second longitudinal positions in the borehole. The method further includes processing the tool face angles to determine a change in borehole azimuth between the first and second positions. Exemplary embodiments of this invention provide a direct mathematical solution for the change in azimuth and therefore provide for improved accuracy and reliability of azimuth determination (as compared to the prior art) over nearly the entire range of possible borehole inclination, azimuth, tool face, and dogleg values.

56 Claims, 3 Drawing Sheets

OTHER PUBLICATIONS

P.E. Berger, R. Sele, Improving Wellbore Position Accuracy of Horizontal Wells by Using a Continuous Inclination Measurement from a Near Bit Inclination MWD Sensor, SPE 50378 (1998).

G.A. McElhinney, A Margeirsson, K. Hamlin, and I. Blok, Gravity MWD: A New Technique to Determine Your Well Path, IADC/SPE 59200 (2000).

S.J. Sawaryn, J.L. Thorogood, A Compendium of Directional Calculations Based on the Minimum Curvature Method, SPE 84246 (2003).

E. Matheson, G McElhinney, and R. Lee, The First Use of Gravity MWD in Offshore Drilling Delivers Reliable Azimuth, SPE 87166 (2004).

McElhinney, G.A., Margeirsson, A., Hamlin, K., and Blok, I., "Gravity MWD: A New Technique To Determine Your Well Path," 2000 IADC/SPE Drilling Conference, New Orleans, Louisiana, Feb. 23-25, 2000, IADC/SPE Paper No. 59200.

Marketing material MagTraC Jun. 2003 by Scientific Drilling available for download at http://www.scientificdrilling.com/pdf/magtrac%20overview.pdf.

* cited by examiner

DETERMINING A BOREHOLE AZIMUTH FROM TOOL FACE MEASUREMENTS

FIELD OF THE INVENTION

The present invention relates generally to surveying subterranean boreholes to determine, for example, the path of the borehole. More particularly, this invention relates to the use of gravity measurement sensors, such as accelerometers, to determine a change in tool face between first and second longitudinal positions in a borehole. Such a change in tool face may be utilized, for example, to determine an azimuth of the borehole.

BACKGROUND OF THE INVENTION

Traditional surveying typically includes two phases. In the first phase, the inclination and azimuth (which, together, essentially define a vector or unit vector tangent to the borehole) are determined at a discrete number of longitudinal points along the borehole (e.g., at a predetermined measured depth interval). Typically, no assumptions are required about the trajectory of the borehole between the discrete measurement points to determine inclination and azimuth. In the second phase, the discrete measurements made in the first phase are assembled into a survey of the well. In general, a particular type of well trajectory is assumed (e.g., the radius of curvature, tangential, balanced tangential, average angle, or minimum curvature assumptions are well known) and utilized to calculate a three-dimensional survey of the borehole. In recent years, the minimum curvature technique has emerged as an industry standard. This technique assumes that a circular arc connects the two measurement points. Referring to the two phases described above, the vectors measured in phase one are assumed to be tangential to the circular arc, and the arc is assumed to have a length equal to the difference in measured depth between the two points.

The use of accelerometers in conventional surveying techniques is well known. The use of magnetometers or gyroscopes in combination with one or more accelerometers to determine direction is also known. Deployments of such sensor sets are well known to determine borehole characteristics such as inclination, azimuth, positions in space, tool face rotation, magnetic tool face, and magnetic azimuth (i.e., an azimuth value determined from magnetic field measurements). While magnetometers and gyroscopes may provide valuable information to the surveyor, their use in borehole surveying, and in particular measurement while drilling (MWD) applications, tends to be limited by various factors. For example, magnetic interference, such as from magnetic steel or ferrous minerals in formations or ore bodies, tends to cause errors in the azimuth values obtained from a magnetometer. Motors and stabilizers used in directional drilling applications are typically permanently magnetized during magnetic particle inspection processes, and thus magnetometer readings obtained in proximity to the bottom hole assembly (BHA) are often unreliable. Gyroscopes are sensitive to high temperature and vibration and thus tend to be difficult to utilize in MWD applications. Gyroscopes also require a relatively long time interval (as compared to accelerometers and magnetometers) to obtain accurate readings. Furthermore, at low angles of inclination (i.e., near vertical), it becomes very difficult to obtain accurate azimuth values from gyroscopes.

U.S. Pat. No. 6,480,119 to McElhinney, hereafter referred to as the '119 patent, discloses a technique for deriving azimuth by comparing measurements from accelerometer sets deployed, for example, along a drill string. Using gravity as a primary reference, the '119 patent discloses a method for determining the change in azimuth between such accelerometer sets. The disclosed method assumes that the gravity sensor sets are displaced along the longitudinal axis of a downhole tool and makes use of the inherent bending of the tool between the gravity sensor sets in order to measure the relative change in azimuth therebetween.

Moreover, as also disclosed in the '119 patent, derivation of the azimuth conventionally requires a tie-in reference azimuth at the start of a survey section. Using a reference azimuth at the start of a survey results in subsequent surveys having to be referenced to each other in order to determine the well path all the way back to the starting tie-in reference. One conventional way to achieve such "chain referencing" is to survey at depth intervals that match the spacing between two sets of accelerometers. For example, if the spacing between the sets of accelerometers is 30 ft then it is preferable that a well is surveyed at 30 ft intervals. Optimally, though not necessarily, the position of the upper set will overlie the previous lower set.

While the borehole surveying techniques disclosed in the '119 patent are known to be commercially serviceable, considerable operator oversight and interaction is required to achieve high quality surveys. Furthermore, frequent calibration is often required during a survey to ensure data quality. It would therefore be highly advantageous to enhance gravity based surveying deployments so that such operator oversight and frequent calibration are not always necessary.

SUMMARY OF THE INVENTION

Exemplary aspects of the present invention are intended to address the above described need for improved gravity based surveying techniques. Referring briefly to the accompanying figures, aspects of this invention include a method for surveying a subterranean borehole. The method utilizes output, for example, from first and second gravity measurement sensors that are longitudinally spaced on a downhole tool. A change in azimuth between the first and second gravity measurement sensors is determined directly from inclination and tool face measurements. In various exemplary embodiments, a drill string includes upper and lower sensor sets including accelerometers. The lower set is typically, but not necessarily, disposed in the bottom hole assembly (BHA), preferably as close as possible to the drill bit assembly. In one exemplary embodiment, supplemental magnetic reference data may be provided by a set of magnetometers deployed at substantially the same longitudinal position as the upper accelerometer set. Embodiments of this invention may be advantageously deployed, for example, in three-dimensional drilling applications in conjunction with measurement while drilling (MWD) and logging while drilling (LWD) methods.

Exemplary embodiments of the present invention may provide several technical advantages. For example, exemplary methods according to this invention may enable the inclination and azimuth of a borehole to be determined without the use of magnetometers or gyroscopes, thereby freeing the measurement system from the constraints of those devices. Further, as stated above, exemplary embodiments of this invention provide a direct mathematical solution for the change in azimuth between gravity sensor sets (rather than a "best fit" solution based on curve fitting techniques). Such a direct solution advantageously provides for improved accuracy and reliability of azimuth determination (as compared to the '119 patent) over nearly the entire range of possible borehole inclination, azimuth, tool face, and dogleg values. Embodiments of this invention also tend to minimize operator oversight and calibration requirements as compared to the '119 patent. Furthermore, exemplary embodiments of this invention may reduce communication bandwidth requirements between a drilling operator and the BHA, thereby advantageously preserving downhole communication bandwidth.

In one aspect the present invention includes a method for surveying a subterranean borehole. The method includes providing first and second survey measurement devices (such as gravity measurement devices) at corresponding first and second longitudinal positions in a drill string in the borehole and causing the first and second survey measurement devices to measure corresponding first and second survey parameters. The method further includes processing the first and second survey parameters to determine tool face angles at the first and second positions in the borehole and processing the tool face angles to determine a change in borehole azimuth between the first and second positions in the borehole.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
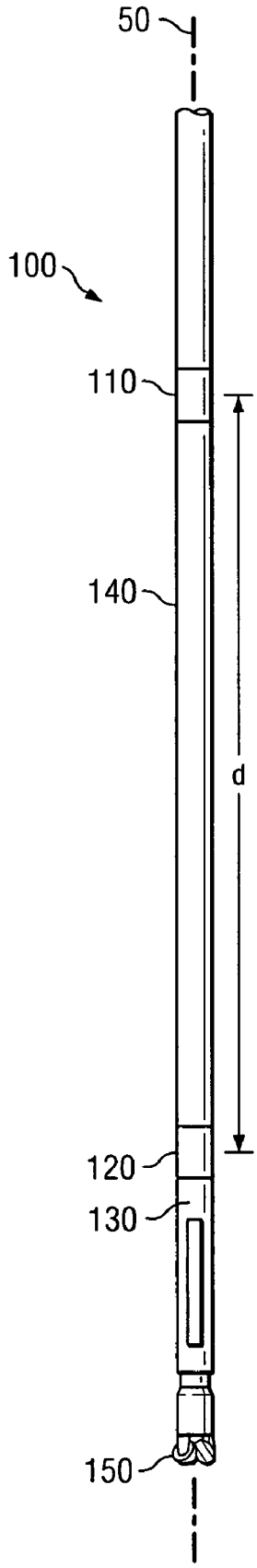
FIG. 1 depicts an exemplary embodiment of a downhole tool according to the present invention including both upper and lower sensor sets 110 and 120.

Referring now to FIG. 1, one exemplary embodiment of a downhole tool 100 according to the present invention is illustrated. In FIG. 1, downhole tool 100 is illustrated as a measurement while drilling (MWD) tool including upper 110 and lower 120 sensor sets coupled to a BHA including, for example, a steering tool 130 and a drill bit assembly 150. FIG. 1 illustrates that upper 110 and lower 120 sensor sets are typically disposed at a known longitudinal spacing 'd' in the downhole tool 100. The spacing 'd' may be, for example, in a range of from about 2 to about 30 meters (i.e., from about 6 to about 100 feet) or more, but the invention is not limited in this regard. Moreover, it will be understood that this invention is not limited to a known or fixed separation between the upper and lower sensor sets 110 and 120. Each sensor set (110 and 120) includes at least two mutually perpendicular gravity sensors, with at least one gravity sensor in each set having a known orientation with respect to a longitudinal axis 50 of the tool 100. Each sensor set (110 and 120) may also optionally include one or more other surveying devices, such as magnetometers and/or gyroscopes. In one exemplary embodiment, each sensor set (110 and 120) includes three mutually perpendicular accelerometers and three mutually perpendicular magnetometers, with at least one accelerometer and one magnetometer in each set having a known orientation with respect to the longitudinal axis 50.

With continued reference to FIG. 1, sensor sets 110 and 120 are connected by a structure 140 that permits bending along its longitudinal axis 50, but tends to resist relative rotational displacement about the longitudinal axis 50 between the upper 110 and lower 120 sensor sets. Structure 140 may include substantially any suitable member, such as a portion of a drill string. Structure 140 may also include one or more MWD or LWD tools, such as acoustic logging tools, neutron density tools, resistivity tools, formation sampling tools, and the like. Alternatively, structure 140 may be a part of substantially any other logging and/or surveying apparatus, such as a wireline surveying tool. It will also be appreciated that while sensor set 120 is shown distinct from steering tool 130, it may be advantageously incorporated into the steering tool 130 in certain embodiments of this invention.

Figure 2:
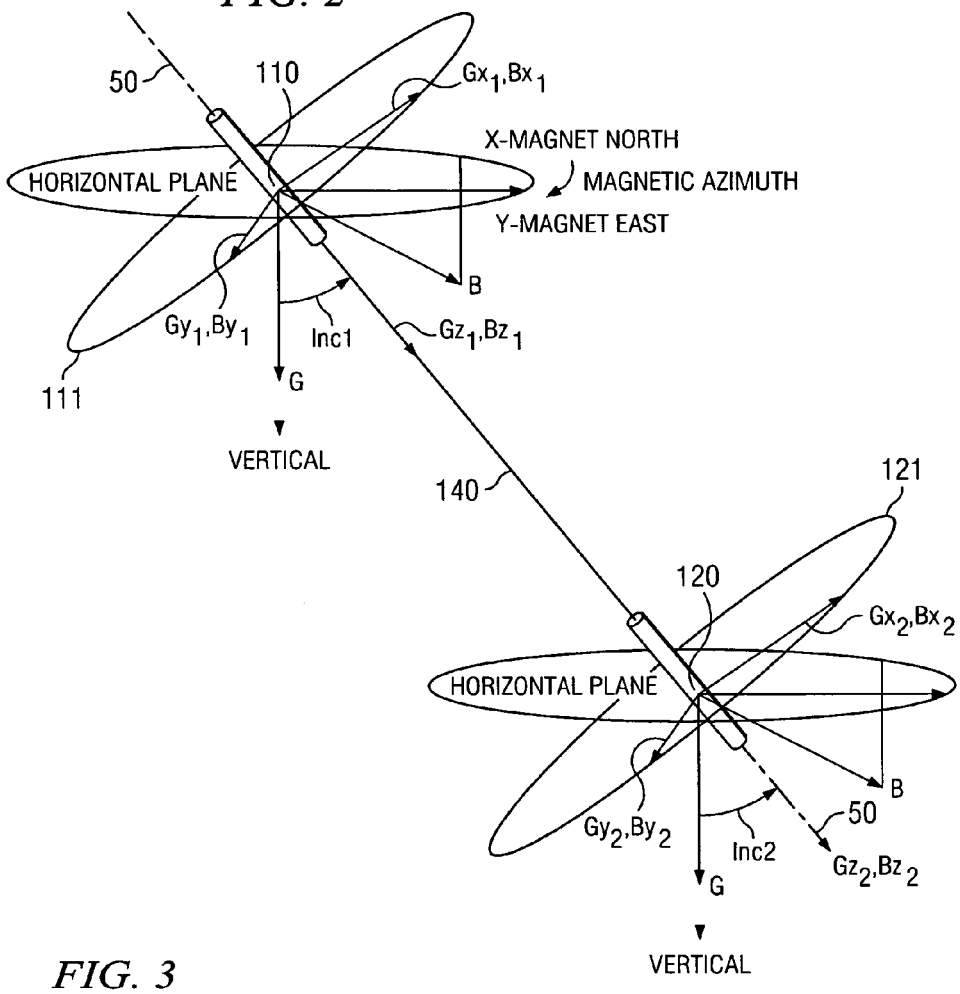
FIG. 2 is a diagrammatic representation of a portion of the downhole tool of FIG. 1 showing unit magnetic field and gravity vectors.

Referring now to FIG. 2, a diagrammatic representation of a portion of the MWD tool of FIG. 1 is illustrated. In the embodiment shown on FIGS. 1 and 2, each sensor set includes three mutually perpendicular gravity sensors, one of which is oriented substantially parallel with the borehole and measures gravity vectors denoted as Gz1 and Gz2 for the upper and lower sensor sets, respectively. The upper 110 and lower 120 sensor sets are linked by a structure 140 (e.g., a semi-rigid tube such as a portion of a drill string) as described above with respect to FIG. 1. Each set of gravity sensors on FIG. 2 thus may be considered as determining a plane (Gx and Gy) and pole (Gz) as shown.

Figure 3:
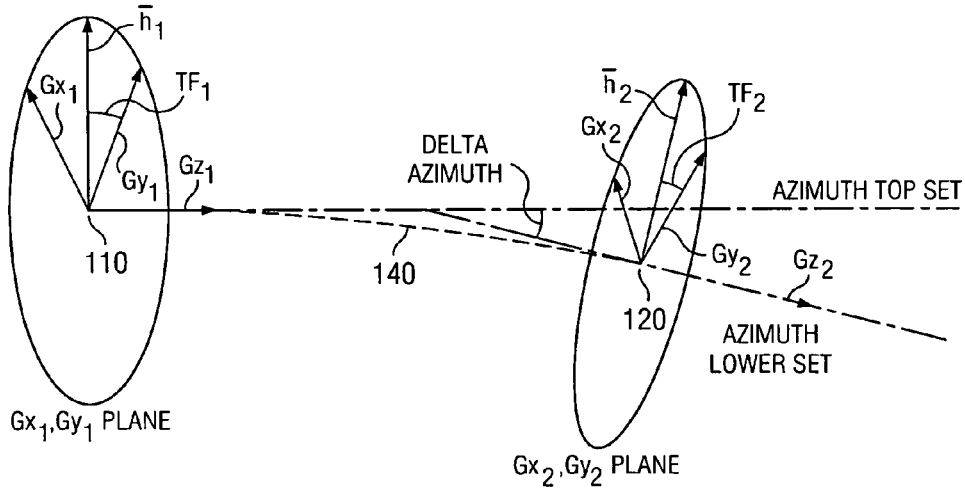
FIG. 3 is another diagrammatic representation of a portion of the downhole tool of FIG. 1 showing a change in azimuth between the upper and lower sensor sets.

Referring now to FIG. 3, the lower sensor set 120 has been displaced with respect to upper sensor set 110 (e.g., by bending structure 140), resulting in a change in azimuth denoted 'delta-azimuth'. Embodiments of the invention described herein assume that Gz1 and Gz2 are substantially coplanar and therefore define a plane referred to herein as the well plane. Referring back to the Background section discussion in this disclosure of two phases of surveying, it will be appreciated that this assumption is implicit in several "phase two" surveying methods, including for example, the minimum curvature, tangential, and balanced tangential methods. Exemplary embodiments of this invention include processing the gravity vectors at the upper 110 and lower 120 sensor sets to determine the well plane and then determining the change in azimuth from the well plane.

With continued reference to FIG. 3, tool face angles TF1 and TF2 of the downhole tool 100 (FIG. 1) at the upper 110 and lower 120 sensor sets are also shown. In the exemplary embodiment shown, the tool face angle TF1 at the upper sensor set 110 is defined as the angle between high side $\overline{h_1}$ and Gy1 and the tool face angle TF2 at the lower sensor set 120 is defined as the angle between high side $\overline{h_2}$ and Gy2. As used herein, the tool face angles TF1 and TF2 are relative to the high side of the of the tool, however, it will be understood that the invention is not limited in this regard, as tool face angles may be referenced to substantially any unit vector in the Gx-Gy plane (e.g., low side, right side, or left side unit vectors).

The following equations describe one exemplary embodiment of a method according to this invention. This analysis assumes that the upper 110 and lower 120 sensor sets are rotationally fixed relative to one another. In summary, the gravity vectors (e.g., as shown in FIGS. 2 and 3) may be utilized to determine inclination and tool face angles at the upper and lower sensor sets 110 and 120. The inclination (Inc1 and Inc2) and tool face (TF1 and TF2) angles may then be utilized to directly determine the change in azimuth between the upper and lower sensor sets 110 and 120.

The inclination angles and tool face angles of the downhole tool 100 may be determined at the upper 110 and lower 120 sensor sets, for example, as follows:

$$Inc1 = \arctan\left(\frac{\sqrt{Gx1^2 + Gy1^2}}{Gz1}\right) \quad \text{Equation 1}$$

$$Inc2 = \arctan\left(\frac{\sqrt{Gx2^2 + Gy2^2}}{Gz2}\right) \quad \text{Equation 2}$$

$$TF1 = \arctan\left(\frac{Gx1}{Gy1}\right) \quad \text{Equation 3}$$

$$TF2 = \arctan\left(\frac{Gx2}{Gy2}\right) \quad \text{Equation 4}$$

where Inc1 and Inc2 represent the inclination angles at the upper and lower sensor sets 110 and 120, TF1 and TF2 represent the tool face angles at the upper and lower sensor sets 110 and 120, and G represents a gravity sensor measurement (such as, for example, a gravity vector measurement), x, y, and z refer to alignment along the x, y, and z axes, respectively, and 1 and 2 refer to the upper 110 and lower 120 sensor sets, respectively. Thus, for example, Gx1 is a gravity sensor measurement aligned along the x-axis taken with the upper sensor set 110.

It will be appreciated that the gravity sensor measurements may be referred to herein as gravity vectors and/or unit vectors, indicating a magnitude of the gravitational field along a particular sensor direction, for example, Gx1, Gy1, etc. It will also be appreciated that the gravity sensor measurements may also be treated as scalar quantities when appropriate, for example, in equations 1 through 4, as shown above. The artisan of ordinary skill will also recognize that the gravity sensor measurements may be normalized, for example, and hence, Gx1, Gy1, etc., represent directional components thereof. It will further be appreciated that Equations 1 through 4 may be expressed equivalently as positive or negative, depending, for example, on the coordinate system used to define Gx, Gy, and Gz.

As described above, the inclination and tool face angles at the upper and lower sensor sets 110 and 120 (determined in Equations 1 through 4) may then be utilized to determine the change in azimuth therebetween. The tool face angles of the borehole at the upper and lower sensor sets 110 and 120 may be expressed, for example, as follows:

$$ToolFace1 = \arctan\left[\frac{\sin(Inc2)\sin(DeltaAzi)}{\sin(Inc2)\cos(Inc1)\cos(DeltaAzi) - \sin(Inc1)\cos(Inc2)}\right] \quad \text{Equation 5}$$

$$ToolFace2 = \arctan\left[\frac{\sin(Inc1)\sin(DeltaAzi)}{\sin(Inc2)\cos(Inc1) - \sin(Inc1)\cos(Inc2)\cos(DeltaAzi)}\right] \quad \text{Equation 6}$$

where ToolFace1 and ToolFace2 represent tool face angles at the upper and lower sensor sets 110 and 120, Inc1 and Inc2 represent the inclination angles of the borehole at the upper and lower sensor sets 110 and 120, and DeltaAzi represents the change in borehole azimuth between the upper and lower sensor sets 110 and 120.

In one exemplary embodiment of this invention, the difference in the tool face angles of the tool 100, TF1 and TF2, for example, determined in Equations 3 and 4, are assumed to be substantially equal to the difference in tool face angles of the borehole, ToolFace1 and Toolface2, for example, determined in Equations 5 and 6. Such an equality may be expressed as follows:

$$TF2 - TF1 = \arctan\left[\frac{\sin(Inc1)\sin(DeltaAzi)}{\sin(Inc2)\cos(Inc1) - \sin(Inc1)\cos(Inc2)\cos(DeltaAzi)}\right] - \arctan\left[\frac{\sin(inc2)\sin(DeltaAzi)}{\sin(Inc2)\cos(Inc1)\cos(DeltaAzi) - \sin(Inc1)\cos(Inc2)}\right] \quad \text{Equation 7}$$

where Inc1 and Inc2 represent the inclination angles at the upper and lower sensor sets 110 and 120, TF1 and TF2 represent the tool face angles at the upper and lower sensor sets 110 and 120, and DeltaAzi represents the change in borehole azimuth between the upper and lower sensor sets 110 and 120. Substituting Inc1, Inc2, TF1 and TF2 from Equations 1 through 4 into Equation 7 yields an expression that may be solved directly for the change in azimuth, DeltaAzi, between the first and second sensor sets 110 and 120. It will be appreciated that Equation 7 may be solved (and a change in azimuth determined) using substantially any known mathematical techniques. For example, Equation 7 may be solved using conventional root finding numerical algorithms, such as the Brent method. Such numerical algorithms are available, for example, via commercial software such as Mathematica® (Wolfram Research, Inc., Champaign, Ill.). Alternatively, Equation 7 may be manipulated using known mathematical techniques to provide a mathematical expression for DeltaAzi in terms of Inc1, Inc2, TF1, and TF2 or alternatively in terms of the measured gravity vectors, Gx1, Gy1, Gz1, Gx2, Gy2, and Gz2. Substitution of the inclination and tool face angles (or the gravity vectors) into such an equation would thus enable DeltaAzi to be calculated directly. It will also be appreciated Equation 7 may be solved using look up tables and/or graphical methods.

Figure 4:
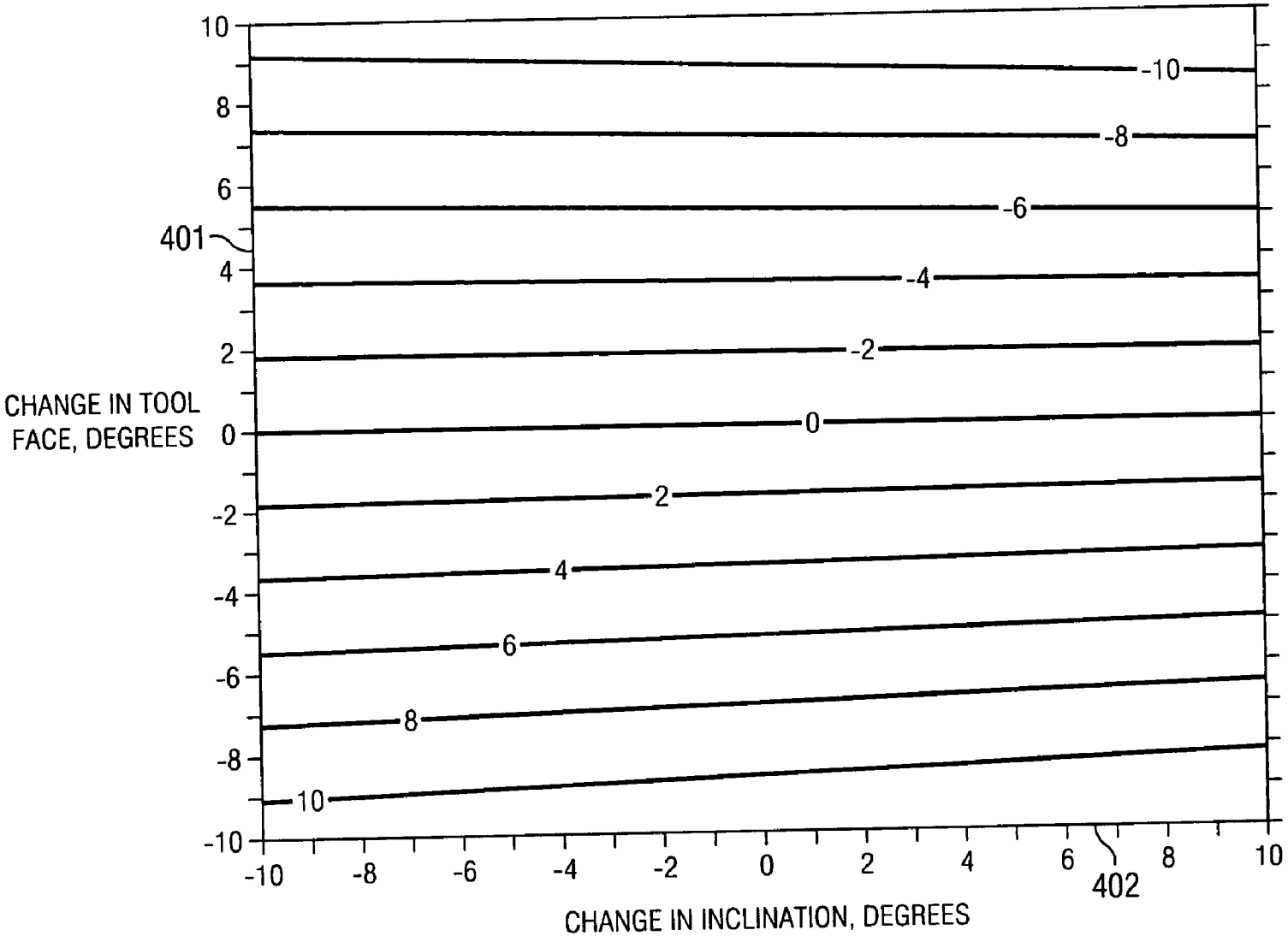
FIG. 4 depicts a contour plot of a change in azimuth versus a change in tool face angle on the vertical axis and change in inclination angle on the horizontal axis.

Turning now to FIG. 4, one exemplary graphical solution to Equation 7 is shown. FIG. 4 illustrates a contour plot of the change in azimuth (DeltaAzi) versus the change in tool face angle (TF2-TF1) on the vertical axis 401 and the change in inclination (Inc2-Inc1) on the horizontal axis 402. In this plot, the inclination at the upper sensor set 110 is assumed to be 30 degrees, however the invention is not limited in this regard. As shown, in this exemplary embodiment, the change in azimuth is substantially proportional to the change in tool face angle and substantially independent of the change in inclination angle between the upper 110 and lower 120 sensor sets. Thus it will be appreciated that for certain embodiments DeltaAzi may be determined directly from a change in the tool face angle between the upper 110 and lower 120 sensor sets and independent of inclination angles at either of the upper 110 or lower 120 sensor sets. In certain other embodiments, DeltaAzi may be determined directly from the change in tool face angle between the upper 110 and lower 120 sensor sets and an inclination angle at one of the upper 110 and lower 110 sensor sets. In such an embodiment, the inclination angle may be utilized, for example via a look up table, to determine a proportionality constant between DeltaAzi and the change in tool face angle between the upper 110 and lower 120 sensor sets.

It will be appreciated that the preceding discussion merely provides exemplary equations, and approaches for solving such equations, to determine the change in azimuth between the upper 110 and lower 120 sensor sets. Other equations (or sets of equations) relating tool face angles (and optionally inclination angles) to borehole azimuth values are considered to be well within the scope of this invention. Additionally, equations (or sets of equations) equating the well plane to borehole azimuth are also considered to be well within the scope of this invention.

Moreover, in the preceding discussion, the tool face and inclination values are determined via gravity sensor measurements (for example as shown in Equations 1 through 4). It will be appreciated that this invention is not limited to utilizing such gravity sensor measurements to determine the tool face angles, TF1 and TF2. Rather, substantially any surveying devices may be utilized to determine the tool face angles, which may then be utilized to determine the change in azimuth.

The above described surveying methodology tends to impute certain advantages as compared to that disclosed in the '119 patent. For example, as described above embodiments of this invention provide a direct solution for DeltaAzi, which improves accuracy and reliability over nearly the entire range of possible borehole inclination, azimuth, tool face, and dogleg values while also tending to minimize operator oversight and calibration requirements. As also stated above, embodiments of this invention may advantageously reduce communication requirements between the surface and the BHA. For example, the method disclosed in the '119 patent typically requires transmitting six gravity vectors (Gx1, Gy1, Gz1, Gx2, Gy2, and Gz2) to the surface at each survey station. However, certain exemplary embodiments of the method disclosed herein only require three parameters (e.g., Inc1, Inc2, and TF2-TF1) to be transmitted to the surface, while certain other exemplary embodiments require only one (TF2-TF1) or two (TF2-TF1 and Inc1 or Inc2) to be transmitted to the surface.

It will be appreciated from the foregoing discussion that the borehole azimuth at the lower sensor set 120 may be described as follows:

$$Azi2=Azi1+DeltaAzi \qquad \text{Equation 8}$$

where Azi1 and Azi2 represent the borehole azimuth at the upper and lower sensor sets 110 and 120, respectively, and DeltaAzi, as described above, represents the change in borehole azimuth between the upper and lower sensor sets 110 and 120 and may be determined, for example, by solving Equation 7.

Using the above relationships, a surveying methodology may be established, in which first and second gravity sensor sets (e.g., accelerometer sets) are deployed, for example, in a drill string. In certain applications (e.g., those in which various regions of the borehole have magnetic interference), it may be necessary to utilize a directional tie-in, i.e., an azimuthal reference, at the start of a survey. The subsequent surveys may then be chain referenced to the tie-in reference. For example, if a new survey point (also referred to herein as a survey station) has a delta azimuth of 2.51 degrees, it may be added to the previous survey point (e.g., 183.40 degrees) to give a new borehole azimuth of 185.91 degrees. A subsequent survey point having a delta azimuth of 1.17 degrees may then be again added to the previous survey point giving a new azimuth of 187.08 degrees.

Using the above methodology, it is generally preferred to survey at intervals equal to the separation distance between the sensor sets. If a new survey point is not exactly the separation distance between the two sensor packages plus the depth of the previous survey point, known extrapolation or interpolation techniques may be used to determine the reference azimuth. However, such extrapolation and interpolation techniques risk the introduction of error to the surveying results. These errors may become significant if long reference chains are required. In order to minimize such errors and reduce the number of required survey stations, it may be desirable in certain applications, to enhance the downhole surveying technique described above with supplemental referencing, thereby reducing (potentially eliminating for some applications) the need for tie-in referencing.

Supplemental reference data may be provided in substantially any suitable form, e.g., as provided by one or more magnetometers and/or gyroscopes. With reference again to FIGS. 1 and 2, in one embodiment, the supplemental reference data are in the form of supplemental magnetometer measurements obtained at the upper sensor set 110. The borehole azimuth value at the upper sensor set 110, may be represented mathematically, utilizing the supplemental magnetometer data, as follows:

$$Azi1 = \arctan\left(\frac{(Gx1*By1-Gy1*Bx1)*\sqrt{Gx1^2+Gy1^2+Gz1^2}}{Bz1*(Gx1^2+Gy1^2)-Gz1*(Gx1*Bx1-Gy1*By1)}\right) \qquad \text{Equation 9}$$

where Azi1 represents the borehole azimuth at the upper sensor set 110, Gx1, Gy1, and Gz1 represent the gravity sensor measurements in the x, y, and z directions at the upper sensor set 110, and Bx1, By1, and Bz1 represent the magnetic field measurements in the x, y, and z directions at the upper sensor set 110.

It will be appreciated that the above arrangement in which the upper sensor set 110 includes a set of magnetometers is merely exemplary. Magnetometer sets may likewise be disposed at the lower sensor set 120. For some applications (e.g., passive ranging applications) it may be advantageous to utilize magnetometer measurements at both the upper 110 and lower 120 sensor sets. Gyroscopes, or other direction sensing devices, may also be utilized to obtain supplemental reference data at either the upper 110 or lower 120 sensor sets.

It will also be appreciated that the above discussion relates to the generalized case in which each sensor set provides three gravity vector measurements, i.e., in the x, y, and z directions. However, it will also be appreciated that it is possible to take only two gravity vector measurements, such as, for example, in the x and y directions only, and to solve for the third vector using existing knowledge of the total gravitational field in the area. The unknown third gravity vector may be expressed as follows:

$$G_3=\sqrt{G^2-G^2-G_2^2} \quad \text{Equation 10}$$

where G3 is the unknown third gravity vector, G is the known local total gravitational vector, and G1 and G2 are the gravity vectors measured by the two gravity sensors in each sensor set (e.g., oriented in the x and y directions). The third gravity vector, G3, may then be used, along with the first two gravity vectors, G1 and G2, in Equations 1 through 4 to solve for the inclination and tool face angles as described previously.

Likewise, in the absence of magnetic interference, it is possible to take only two magnetic field measurements and to solve for the third using existing knowledge of the total magnetic field in the area. The unknown third magnetic field vector may be expressed as follows:

$$B_3=\sqrt{B^2-B_1^2-B_2^2} \quad \text{Equation 11}$$

where B3 is the unknown third magnetic field vector, B is the known local total magnetic field vector, and B1 and B2 are the magnetic field vectors measured by the two magnetic field measurement sensors in each sensor set (e.g., oriented in the x and y directions). The third magnetic field vector, B3, may then be used, along with the first two magnetic field vectors, B1 and B2, in Equation 9 to solve for the borehole azimuth as described previously.

The artisan of ordinary skill will readily recognize that Equations 8 and 9 result in a positive solution for G3 and B3, respectively. Thus, additional information is typically required in order to accurately determine the sign (positive or negative) of the unknown vector. For example, when Gz is the unknown gravity vector, knowledge of the vertical orientation of the tools may be required, e.g., whether a drilling tool is drilling downward (positive z) or upward (negative z). Alternatively, a survey tool may be rotated in the borehole and surveys taken at two or more rotational orientations. For most applications it is preferable to utilize three mutually orthogonal sensors and to measure each of the three gravity and/or magnetic field vectors. Nevertheless, in operation, situations may arise (such as a failed sensor) in which the use of Equations 10 and/or 11 are useful in the solution of an unknown gravity or magnetic field vector.

As described above with respect to Equation 8, the azimuth at the lower sensor set 120 equals the sum of a the azimuth at the first sensor set 110 and the change in azimuth between the two sensor sets 110 and 120. Utilizing supplemental referencing advantageously enhances the accuracy of the borehole azimuth value by enhancing the accuracy, for example, of the azimuth at the upper sensor set. Supplemental referencing, however, is not necessarily advantageous in improving the accuracy of the measured change in azimuth between the sensor sets. In certain embodiments of this invention, it may also be desirable, or even required, to correct for causes that result in significant errors to calculating the change in azimuth. One such potential source of error is rotational offset between the gravity sensor sets (i.e., misalignment between the x and y axes of the sensor sets). If the two sets of gravity sensors are not rotationally aligned, it may be possible to physically measure the rotational offset between them as an angular displacement, for example, by physically measuring the orientation of each sensor set in the tool as it is lowered into the borehole. Alternatively, the rotational offset between the sensor sets may be calculated from gravity vector measurements. For example, the tool may be positioned on a shop floor or at the surface of a drilling rig (e.g., in an approximately horizontal position) such that there is substantially no azimuthal difference between the sensor sets (i.e., tool is substantially straight). Gravity tool face angles may then be determined, for example, according to Equations 3 and 4 as described above. In such a configuration, the rotational offset may be considered to be equal to the difference between the gravity tool face angles. It will be appreciated that once identified and measured or calculated, any rotational offset may then be corrected for, for example, by correcting the gravity vectors at one of the sensor sets.

In some applications, it may be advantageous to be able to determine any rotational offset downhole as well as topside. For example, in certain embodiments, the rotational offset may be determined and corrected for if azimuth values from a section of the borehole are previously known, for example, from a previous gyroscope survey. Measured azimuth values may then be compared with the previously determined azimuth values to determine the rotational offset. Known numerical methods, including, for example, least squares techniques that iterate the rotational offset, may readily be used to determine the best fit between the previously determined azimuth values and those determined in the gravity survey. Alternatively, the rotational offset may be determined using known graphical methods, for example, in a spread sheet software package, and the rotational offset values manually iterated until a graphical "best-fit" is achieved.

The approach described above for determining the rotational offset between the upper and lower accelerometer sets may also advantageously provide an error reduction scheme that corrects for other systemic errors in addition to the rotational offset. Utilization of the above-described approach advantageously corrects for substantially all azimuthal misalignment errors between the accelerometer sets.

As described above with respect to FIG. 1, one exemplary embodiment of downhole tool 100 includes three mutually perpendicular accelerometers and three mutually perpendicular magnetometers deployed at each sensor set 110 and 120. Such an embodiment may be advantageously utilized in various passive ranging applications, such as well twinning applications, in which magnetic interference from a target subterranean structure is measured. The magnetic interference may be measured as a vector whose orientation depends on the location of the measurement point within the magnetic field. In order to determine the magnetic interference vector at any point downhole, the magnetic field of the earth is subtracted from the measured magnetic field vector. Such magnetic interference vectors may be determined at one or both of the upper and lower sensor sets 110 and 120 and utilized to determine the location (direction and distance) of the subterranean structure relative to the upper and lower sensor sets and to guide continued drilling of the borehole.

The magnetic field of the earth (including both magnitude and direction components) is typically known, for example, from previous geological survey data, on site measurements in regions free from magnetic interference, and/or mathematical modeling (i.e., computer modeling) routines. The earth's magnetic field at the tool may be expressed as follows:

$$M_{EX}=H_E(\cos D \sin Azi \cos TF+\cos D \cos Azi \cos Inc \sin TF-\sin D \sin Inc \sin TF)$$

$$M_{EY}=H_E(\cos D \cos Azi \cos Inc \cos TF+\sin D \sin Inc \cos TF-\cos D \sin Azi \sin TF)$$

$$M_{EZ}=H_E(\sin D \cos Inc-\cos D \cos Azi \sin Inc) \quad \text{Equation 12}$$

where Mex, Mey, and Mez represent the x, y, and z components, respectively, of the earth's magnetic field as measured at the downhole tool, where the z component is aligned with the borehole axis, He is known (or measured as described above) and represents the magnitude of the earth's magnetic field, and D, which is also known (or measured), represents the local magnetic dip. Inc, Azi, and TF represent the inclination, azimuth and tool face, respectively, of the tool, which may be obtained, for example, from the gravity surveying techniques described herein (e.g., in Equations 1 through 7).

The magnetic interference vectors may then be represented as follows:

$$M_{IX}=B_X-M_{EX}$$

$$M_{IY}=B_Y-M_{EY}$$

$$M_{IZ}=B_Z-M_{EZ} \quad \text{Equation 13}$$

where Mix, Miy, and Miz represent the x, y, and z components, respectively, of the magnetic interference vector and Bx, By, and Bz, as described above, represent the measured magnetic field vectors in the x, y, and z directions, respectively. The artisan of ordinary skill will readily recognize that in determining the magnetic interference vectors it may also be necessary to subtract other magnetic field components, such as drill string and/or motor interference from the borehole being drilled, from the measured magnetic field vectors. Techniques for accounting for such other magnetic field components are well known in the art.

Embodiments of this invention may also advantageously be utilized to directly determine other borehole parameters, such as the build rate, turn rate, and dogleg severity. Such borehole parameters may advantageously be determined without supplemental or tie-in referencing and may be given, for example, as follows:

$$BuildRate = \frac{Inc2 - Inc1}{d} \quad \text{Equation 14}$$

$$TurnRate = \frac{DeltaAzi}{d} \quad \text{Equation 15}$$

$$DLS = \frac{\arccos\left[\begin{array}{c}\cos(DeltaAzi)\sin(Inc1)\sin(Inc2)+\\ \cos(Inc1)\cos(Inc2)\end{array}\right]}{d} \quad \text{Equation 16}$$

$$DLS = \frac{\arcsin\left[\begin{array}{c}\sin^2\left(\frac{Inc2-Inc1}{2}\right)+\\ \sin(Inc1)\sin(Inc2)\sin^2\left(\frac{DeltaAzi}{2}\right)\end{array}\right]}{d} \quad \text{Equation 17}$$

where Inc1 and Inc2 represent the inclination values determined at the first and second sensor sets 110, 120, respectively (for example as determined according to Equations 1 and 2), DeltaAzi represents the change in borehole azimuth between the first and second sensor sets 110, 120 (for example determined by solving Equation 7), d represents the longitudinal distance between the first and second sensor sets 110, 120 (as shown in FIG. 1), and BuildRate, TurnRate, and DLS represent the build rate, turn rate and dogleg severity of the borehole. The borehole tool face may be determined, for example, using Equations 5 and 6. Equation 17 is an alternative expression for the dogleg severity that may be preferable at small angles since it includes an arc sine expression rather than arc cosine expression given in Equation 16.

It will be understood that the aspects and features of the present invention may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

I claim:

1. A method for surveying a subterranean borehole, the method comprising:

(a) providing first and second survey measurement devices at corresponding first and second longitudinal positions in a drill string in the borehole;

(b) causing the first and second survey measurement devices to measure corresponding first and second survey parameters;

(c) processing the first and second survey parameters to determine tool face angles at the first and second positions in the borehole; and (d) processing the tool face angles determined in (c) to determine a change in borehole azimuth between the first and second positions in the borehole.

2. The method of claim 1, wherein:

the first and second surveying devices include corresponding first and second gravity measurement sensors; and the first and second survey parameters include corresponding first and second gravity vector sets.

3. The method of claim 1, wherein (c) further comprises processing the first and second survey parameters to determine an inclination angle at at least one of the first and second positions in the borehole.

4. The method of claim 1 wherein (c) further comprises processing the first and second survey parameters to determine inclination angles at the first and second positions in the borehole.

5. The method of claim 1, wherein the change in borehole azimuth is substantially proportional to a difference between the tool face angles at the first and second positions.

6. A method for surveying a subterranean borehole, the method comprising:

(a) providing first and second gravity measurement devices at corresponding first and second longitudinal positions in a drill string in the borehole, the first and second gravity measurement devices being substantially constrained from rotating with respect to one another about a substantially cylindrical borehole axis, (b) causing the first and second gravity measurement devices to measure corresponding first and second gravity vector sets;

(c) processing the first and second gravity vector sets to determine inclination and tool face angles at the first and second positions in the borehole; and (d) processing the inclination and tool face angles determined in (c) to determine a change in borehole azimuth between the first and second positions in the borehole.

7. The method of claim 6, wherein the first and second gravity measurement devices comprise accelerometers.

8. The method of claim 6, wherein at least one of the gravity vector sets comprises first and second gravity vectors.

9. The method of claim 8, wherein (c) further comprises deriving a third gravity vector for the at least one gravity vector set, the third gravity vector derived from processing the corresponding first and second gravity vectors and a known total gravitational field of the Earth.

10. The method of claim 9, wherein the third gravity vector is derived according to the equation:

$$G_3=\sqrt{G^2-G_1^2-G_2^2}$$

wherein $G_3$ is the third gravity vector, G is the known total gravitational field of the earth, and $G_1$ and $G_2$ are the first and second gravity vectors, respectively.

11. The method of claim 6, wherein each gravity vector set comprises first, second, and third gravity vectors.

12. The method of claim 6, wherein the first and second gravity measurement devices are deployed in a measurement while drilling tool.

13. The method of claim 6, wherein the second position is located in a bottom hole assembly.

14. The method of claim 6, wherein the inclination and tool face angles are determined in (c) according to the equations:

$$Inc1 = \arctan\left(\frac{\sqrt{Gx1^2 + Gy1^2}}{Gz1}\right)$$

$$Inc2 = \arctan\left(\frac{\sqrt{Gx2^2 + Gy2^2}}{Gz2}\right)$$

$$TF1 = \arctan\left(\frac{Gx1}{Gy1}\right)$$

$$TF2 = \arctan\left(\frac{Gx2}{Gy2}\right)$$

wherein Inc1 and Inc2 represent the inclination angles at the first and second positions, respectively; TF1 and TF2 represent the tool face angles at the first and second positions, respectively; Gx1, Gy1, and Gz1 represent first, second, and third gravity vectors measured at the first position; and Gx2, Gy2, and Gz2 represent first, second, and third gravity vectors measured at the second position.

15. The method of claim 6, wherein (c) further comprises determining a change in the tool face angle between the first and second positions.

16. The method of claim 15, wherein (d) further comprises processing the change in the tool face angle between the first and second positions to determine a change in borehole azimuth between the first and second positions in the borehole.

17. The method of claim 16, wherein the change in borehole azimuth between the first and second positions is determined in (d) according to the equation:

$$TF2 - TF1 = \arctan\left[\frac{\sin(Inc1)\sin(DeltaAzi)}{\sin(Inc2)\cos(Inc1) - \sin(Inc1)\cos(Inc2)\cos(DeltaAzi)}\right] - \arctan\left[\frac{\sin(inc2)\sin(DeltaAzi)}{\sin(Inc2)\cos(Inc1)\cos(DeltaAzi) - \sin(Inc1)\cos(Inc2)}\right]$$

wherein DeltaAzi represents the change in azimuth between the first and second positions; Inc1 and Inc2 represent the inclination angles at the first and second positions, respectively; and TF1 and TF2 represent the tool face angles at the first and second positions, respectively.

18. The method of claim 17, wherein DeltaAzi is determined using at least one technique selected from the group consisting of a numerical algorithm, a lookup table, and a graphical solution.

19. The method of claim 6, wherein a supplemental reference measurement device is also deployed at the first position.

20. The method of claim 19, wherein the supplemental reference measurement device is selected from the group consisting of: (A) a gyroscope, and (B) a magnetometer.

21. The method of claim 6, wherein corresponding first and second supplemental reference measurement devices are deployed at the first and second positions.

22. The method of claim 19, further comprising:

(e) determining a borehole azimuth at the first position using the supplemental reference measurement device;

(f) processing the borehole azimuth at the first position determined in (e) and the change in borehole azimuth determined in (d) to determine a borehole azimuth at the second position.

23. The method of claim 22, wherein the borehole azimuth at the first position is determined in (e) according to the equation:

$$Azi1 = \arctan\left(\frac{(Gx1 * By1 - Gy1 * Bx1) * \sqrt{Gx1^2 + Gy1^2 + Gz1^2}}{Bz1 * (Gx1^2 + Gy1^2) - Gz1 * (Gx1 * Bx1 - Gy1 * By1)}\right)$$

wherein Azi1 represents the borehole azimuth at the first position; Bx1, By1, and Bz1 represent first, second, and third magnetic field vectors measured at the first position; and Gx1, Gy1, and Gz1 represent first, second, and third gravity vectors measured at the first position.

24. The method of claim 22, wherein the borehole azimuth at the second position is determined in (f) according to the equation:

$$Azi2=Azi1+DeltaAzi$$

wherein Azi2 represents the borehole azimuth at the second position, Azi1 represents the borehole azimuth at the first position, and DeltaAzi represents the change in borehole azimuth.

25. The method of claim 6, further comprising:

(e) establishing a borehole azimuth at one of the first and second positions via reference to a previously surveyed azimuthal reference point in the borehole.

26. The method of claim 6, further comprising:

(e) establishing a borehole azimuth at one of the first and second positions via chain referencing to a previously surveyed azimuthal reference point in the borehole.

27. The method of claim 6, wherein the first and second gravity measurement devices are rotationally offset from one another, said rotational offset being determined prior to providing the first and second gravity measurement devices in the borehole by a procedure comprising:

(1) positioning the first and second gravity measurement devices such that there is substantially no change in azimuth therebetween;

(2) causing the first and second gravity measurement devices to measure corresponding first and second gravity vector sets;

(c) processing the first and second gravity vector sets to determine gravity tool face angles; and (d) processing the gravity tool face angles to determine the rotational offset.

28. The method of claim 6, wherein the first and second positions are located in a previously surveyed section of the borehole including a historical survey, the method further comprising:

(e) comparing the change in azimuth determined in (d) with azimuth values from the historical survey; and (f) determining a rotational offset between the first and second gravity measurement devices that gives a best fit in (e) between the change in azimuth determined in (d) and the historical survey.

29. The method of claim 6, wherein corresponding first and second magnetic field measurement devices are disposed at the first and second positions in the borehole, and wherein the first and second positions are selected to be within sensory range of magnetic flux from a target subterranean structure, the method further comprising:

(e) measuring local magnetic fields at the first and second positions using the corresponding first and second magnetic field measurement devices;

(f) processing (1) the local magnetic fields at the first and second positions, and (2) a reference magnetic field, to determine a portion of the local magnetic fields attributable to the target subterranean structure;

(g) generating interference magnetic field vectors at the first and second positions from the portion of the local magnetic fields attributable to the target subterranean structure.

30. The method of claim 29, further comprising:

(h) processing the interference magnetic field vectors in (g) to determine a location of the target subterranean structure relative to the first and second positions.

31. The method of claim 29, wherein the inclination and tool face angles determined in (c) are utilized to determine the interference magnetic field vectors in (g).

32. The method of claim 29, wherein the interference magnetic field vectors in (g) are determined according to the Equation:

$$M_{IX}=B_X-M_{EX}$$

$$M_{IY}=B_Y-M_{EY}$$

$$M_{IZ}=B_Z-M_{EZ}$$

wherein Mix, Miy, and Miz represent x, y, and z components of the interference magnetic field vectors; Mex, Mey, and Mez represent the x, y and z components of the reference magnetic field; and Bx, By, and Bz represent x, y, and z components of the local magnetic field.

33. The method of claim 6, further comprising:

(e) processing the inclination angles determined in (c) and the change in azimuth determined in (d) to determine at least one parameter selected from the group consisting of a build rate, a turn rate, and a dogleg severity of the borehole.

34. The method of claim 6, further comprising:

(e) processing the inclination angles determined in (c) and the change in azimuth determined in (d) to determine a build rate of the borehole according to the equation:

$$BuildRate = \frac{Inc2 - Inc1}{d}$$

wherein Inc1 and Inc2 represent the inclination angles determined in (c) at the first and second positions, respectively; d represents a longitudinal distance between the first and second sensor sets; and BuildRate represents the build rate of the borehole.

35. The method of claim 6, further comprising:

(e) processing the inclination angles determined in (c) and the change in azimuth determined in (d) to determine a turn rate of the borehole according to the equation:

$$TurnRate = \frac{DeltaAzi}{d}$$

wherein DeltaAzi represents the change in borehole azimuth between the first and second positions determined in (d), d represents a longitudinal distance between the first and second sensor sets, and TurnRate represents turn rate of the borehole.

36. The method of claim 6, further comprising:

(e) processing the inclination angles determined in (c) and the change in azimuth determined in (d) to determine a dogleg severity of the borehole according to an equation selected from the group consisting of:

$$DLS = \frac{\arccos\left[\begin{array}{c}\cos(DeltaAzi)\sin(Inc1)\sin(Inc2) + \\ \cos(Inc1)\cos(Inc2)\end{array}\right]}{d}$$

$$DLS = \frac{\arcsin\left[\begin{array}{c}\sin^2\left(\frac{Inc2 - Inc1}{2}\right) + \\ \sin(Inc1)\sin(Inc2)\sin^2\left(\frac{DeltaAzi}{2}\right)\end{array}\right]}{d}$$

wherein Inc1 and Inc2 represent the inclination angles determined in (c) at the first and second positions, respectively; DeltaAzi represents the change in borehole azimuth between the first and second positions determined in (d); d represents a longitudinal distance between the first and second sensor sets; and DLS represents the dogleg severity of the borehole.

37. A system for surveying a borehole, the system comprising:

first and second gravity measurement devices, the first and second gravity measurement devices deployed at corresponding first and second longitudinal positions along a substantially cylindrical axis on a drill string, the gravity measurement devices substantially constrained from rotational movement with respect to one another about the cylindrical axis, the first and second gravity measurement devices operable to be positioned in a borehole; and a processor configured to determine:

(A) inclination and tool face angles at the first and second positions in the borehole using outputs from the gravity measurement devices; and (B) a change in borehole azimuths between the first and second positions using the inclination and tool face angles determined in (A).

38. The system of claim 37, wherein:

a supplemental reference measurement device is deployed at the first position; and the processor is further configured to determine:

(C) a borehole azimuth at the first position using an output from the supplemental reference measurement device; and (D) a borehole azimuth at the second position by applying the change in borehole azimuth determined in (B) to the reference borehole azimuth determined in (C).

39. The system of claim 38, wherein:

each of the gravity measurement devices comprises first, second, and third accelerometers; and the supplemental reference measurement device comprises first, second, and third magnetometers.

40. A computer system comprising:

at least one processor; and a storage device having computer-readable logic stored therein, the computer-readable logic accessible by and intelligible to the processor;

the processor further disposed to receive input from first and second gravity measurement devices when said first and second measurement devices are (1) deployed at corresponding first and second longitudinal positions in a borehole, and (2) also substantially constrained from rotating with respect to one another about a substantially cylindrical axis along the borehole;

the computer-readable logic further configured to instruct the processor to execute a method for determining the change in borehole azimuth between the first and second positions, the method comprising:

(a) determining inclination and tool face angles at the first and second positions using input from the first and second gravity measurement sensors; and (b) determining the change in borehole azimuth between the first and second positions using the inclination and tool face angles determined in (a).

41. The computer system of claim 40, wherein the inclination and tool face angles are determined in (a) according to the equations:

$$Inc1 = \arctan\left(\frac{\sqrt{Gx1^2 + Gy1^2}}{Gz1}\right)$$

-continued $$Inc2 = \arctan\left(\frac{\sqrt{Gx2^2 + Gy2^2}}{Gz2}\right)$$

$$TF1 = \arctan\left(\frac{Gx1}{Gy1}\right)$$

$$TF2 = \arctan\left(\frac{Gx2}{Gy2}\right)$$

wherein Inc1 and Inc2 represent the inclination angles at the first and second positions, respectively; TF1 and TF2 represent the tool face angles at the first and second positions, respectively; Gx1, Gy1, and Gz1 represent first, second, and third gravity vectors measured at the first position; and Gx2, Gy2, and Gz2 represent first, second, and third gravity vectors measured at the second position.

42. The computer system of claim 40, wherein the change in borehole azimuth between the first and second positions is determined in (b) according to the equation:

$$TF2 - TF1 = \arctan\left[\frac{\sin(Inc1)\sin(DeltaAzi)}{\sin(Inc2)\cos(Inc1) - \sin(Inc1)\cos(Inc2)\cos(DeltaAzi)}\right] - \arctan\left[\frac{\sin(inc2)\sin(DeltaAzi)}{\sin(Inc2)\cos(Inc1)\cos(DeltaAzi) - \sin(Inc1)\cos(Inc2)}\right]$$

wherein DeltaAzi represents the change in azimuth between the first and second positions; Inc1 and Inc2 represent the inclination angles at the first and second positions, respectively; and TF1 and TF2 represent the tool face angles at the first and second positions, respectively.

43. The computer system of claim 40, wherein:

the processor is further disposed to receive input from a supplemental reference measurement device deployed at the first position; and the computer readable logic is further configured to determine a borehole azimuth at the second position according to the equation:

$$Azi2 = Azi1 + DeltaAzi$$

wherein Azi2 represents the borehole azimuth at the second position, Azi1 represents the borehole azimuth at the first position, and DeltaAzi represents the change in borehole azimuth.

44. The computer system of claim 43, wherein:

the borehole azimuth at the first position is determined according to the equation:

$$Azi1 = \arctan\left(\frac{(Gx1 * By1 - Gy1 * Bx1) * \sqrt{Gx1^2 + Gy1^2 + Gz1^2}}{Bz1 * (Gx1^2 + Gy1^2) - Gz1 * (Gx1 * Bx1 - Gy1 * By1)}\right)$$

wherein Bx1, By1, and Bz1 represent first, second, and third magnetic field vectors measured at the first position; and Gx1, Gy1, and Gz1 represent first, second, and third gravity vectors measured at the first position.

45. The computer system of claim 40, wherein the computer readable logic is further configured to process the inclination angles determined in (a) and the change in azimuth determined in (b) to determine a build rate and a turn rate of the borehole according to the equations:

$$BuildRate = \frac{Inc2 - Inc1}{d}$$

$$TurnRate = \frac{DeltaAzi}{d}$$

wherein Inc1 and Inc2 represent the inclination angles determined in (a) at the first and second positions, respectively; DeltaAzi represents the change in borehole azimuth between the first and second positions determined in (b); d represents a longitudinal distance between the first and second sensor sets; BuildRate represents the build rate of the borehole; and TurnRate represents the turn rate of the borehole.

46. The computer system of claim 40, wherein the computer readable logic is further configured to process the inclination angles determined in (a) and the change in azimuth determined in (b) to determine a dogleg severity of the borehole according to one of the equations selected from the group consisting of:

$$DLS = \frac{\arccos\left[\begin{array}{c}\cos(DeltaAzi)\sin(Inc1)\sin(Inc2) + \\ \cos(Inc1)\cos(Inc2)\end{array}\right]}{d}$$

$$DLS = \frac{\arcsin\left[\begin{array}{c}\sin^2\left(\frac{Inc2 - Inc1}{2}\right) + \\ \sin(Inc1)\sin(Inc2)\sin^2\left(\frac{DeltaAzi}{2}\right)\end{array}\right]}{d}$$

wherein Inc1 and Inc2 represent the inclination angles determined in (a) at the first and second positions, respectively; DeltaAzi represents the change in borehole azimuth between the first and second positions determined in (b); d represents a longitudinal distance between the first and second sensor sets; and DLS represents the dogleg severity of the borehole.

47. A computer readable medium storing a software program, the software program configured to enable a processor to perform a method for surveying a subterranean borehole, the method comprising:

(a) causing first and second gravity measurement devices deployed at corresponding first and second longitudinal positions in a drill string in the borehole to measure corresponding first and second gravity vector sets;

(b) processing the first and second gravity vector sets to determine inclination and tool face angles at the corresponding first and second positions in the borehole; and (c) processing the inclination and tool face angles determined in (b) to determine a change in borehole azimuth between the first and second positions in the borehole.

48. The computer readable medium of claim 47, wherein the inclination and tool face angles are determined in (b) according to the equations:

$$Inc1 = \arctan\left(\frac{\sqrt{Gx1^2 + Gy1^2}}{Gz1}\right)$$

-continued $$Inc2 = \arctan\left(\frac{\sqrt{Gx2^2 + Gy2^2}}{Gz2}\right)$$

$$TF1 = \arctan\left(\frac{Gx1}{Gy1}\right)$$

$$TF2 = \arctan\left(\frac{Gx2}{Gy2}\right)$$

wherein Inc1 and Inc2 represent the inclination angles at the first and second positions, respectively; TF1 and TF2 represent the tool face angles at the first and second positions in the borehole, respectively; Gx1, Gy1, and Gz1 represent first, second, and third gravity vectors measured at the first position; and Gx2, Gy2, and Gz2 represent first, second, and third gravity vectors measured at the second position.

49. The computer readable medium of claim 47, wherein:

(b) further comprises determining a change in the tool face angle between the first and second positions in the borehole; and (c) further comprises processing the change in the tool face angle determined in (b) to determine a change in borehole azimuth between the first and second positions in the borehole.

50. The computer readable medium of claim 47, wherein the change in borehole azimuth between the first and second positions is determined in (c) according to the equation:

$$TF2 - TF1 = \arctan\left[\frac{\sin(Inc1)\sin(DeltaAzi)}{\sin(Inc2)\cos(Inc1) - \sin(Inc1)\cos(Inc2)\cos(DeltaAzi)}\right] - \arctan\left[\frac{\sin(inc2)\sin(DeltaAzi)}{\sin(Inc2)\cos(Inc1)\cos(DeltaAzi) - \sin(Inc1)\cos(Inc2)}\right]$$

wherein DeltaAzi represents the change in azimuth between the first and second positions; Inc1 and Inc2 represent the inclination angles at the first and second positions, respectively; and TF1 and TF2 represent the tool face angles at the first and second positions, respectively.

51. The method of claim 50, wherein DeltaAzi is determined using at least one technique selected from the group consisting of a numerical algorithm, a lookup table, and a graphical solution.

52. A computer readable medium storing a software program, the software program configured to enable a processor to perform a method for surveying a subterranean borehole, the method comprising:

(a) receiving first and second gravity vector set measurements from corresponding first and second gravity measurement devices deployed at corresponding first and second longitudinal positions in a drill string in the borehole;

(b) processing the first and second gravity vector sets to determine inclination and tool face angles at the corresponding first and second positions in the borehole; and (c) processing the inclination and tool face angles determined in (b) to determine a change in borehole azimuth between the first and second positions in the borehole.

53. The computer readable medium of claim 52, wherein the inclination and tool face angles are determined in (b) according to the equations:

$$Inc1 = \arctan\left(\frac{\sqrt{Gx1^2 + Gy1^2}}{Gz1}\right)$$

$$Inc2 = \arctan\left(\frac{\sqrt{Gx2^2 + Gy2^2}}{Gz2}\right)$$

$$TF1 = \arctan\left(\frac{Gx1}{Gy1}\right)$$

$$TF2 = \arctan\left(\frac{Gx2}{Gy2}\right)$$

wherein Inc1 and Inc2 represent the inclination angles at the first and second positions, respectively; TF1 and TF2 represent the tool face angles at the first and second positions in the borehole, respectively; Gx1, Gy1, and Gz1 represent first, second, and third gravity vectors measured at the first position; and Gx2, Gy2, and Gz2 represent first, second, and third gravity vectors measured at the second position.

54. The computer readable medium of claim 52, wherein:

(b) further comprises determining a change in the tool face angle between the first and second positions in the borehole; and (c) further comprises processing the change in the tool face angle determined in (b) to determine a change in borehole azimuth between the first and second positions in the borehole.

55. The computer readable medium of claim 52, wherein the change in borehole azimuth between the first and second positions is determined in (c) according to the equation:

$$TF2 - TF1 = \arctan\left[\frac{\sin(Inc1)\sin(DeltaAzi)}{\sin(Inc2)\cos(Inc1) - \sin(Inc1)\cos(Inc2)\cos(DeltaAzi)}\right] - \arctan\left[\frac{\sin(inc2)\sin(DeltaAzi)}{\sin(Inc2)\cos(Inc1)\cos(DeltaAzi) - \sin(Inc1)\cos(Inc2)}\right]$$

wherein DeltaAzi represents the change in azimuth between the first and second positions; Inc1 and Inc2 represent the inclination angles at the first and second positions, respectively; and TF1 and TF2 represent the tool face angles at the first and second positions, respectively.

56. The method of claim 55, wherein DeltaAzi is determined using at least one technique selected from the group consisting of a numerical algorithm, a lookup table, and a graphical solution.

* * * * *